United States Patent [19]

Venot et al.

[11] 4,247,503

[45] Jan. 27, 1981

[54] PROCESS FOR PRODUCTION OF CRIMPABLE CHEMICAL YARNS

[75] Inventors: Jean Venot, Roanne; André Mottet, Lyons, both of France

[73] Assignee: ASA S.A., Roanne, France

[21] Appl. No.: 962,975

[22] Filed: Nov. 22, 1978

[30] Foreign Application Priority Data

Nov. 25, 1977 [FR] France ..... 77 36457

[51] Int. Cl.[3] ..... D01D 5/22

[52] U.S. Cl. ..... 264/168; 264/171; 264/176 F

[58] Field of Search ..... 264/176 F, 168; 425/144

[56] References Cited

U.S. PATENT DOCUMENTS

| | | | |
|---|---|---|---|
| 3,437,725 | 4/1969 | Pierce | 264/176 F |
| 3,904,730 | 9/1975 | Shimizu et al. | 264/168 |
| 4,015,963 | 4/1977 | Levesque et al. | 264/176 F |
| 4,124,673 | 11/1978 | Piper et al. | 264/171 |
| 4,187,269 | 2/1980 | Hutchinson et al. | 264/171 |

FOREIGN PATENT DOCUMENTS

| | | | |
|---|---|---|---|
| 2132094 | 1/1973 | Fed. Rep. of Germany | 264/171 |
| 46-37763 | 11/1971 | Japan | 264/171 |
| 548668 | 2/1977 | U.S.S.R. | 264/171 |

*Primary Examiner*—Jay H. Woo

*Attorney, Agent, or Firm*—Frank S. Vaden III

[57] ABSTRACT

The process of an apparatus for asymmetrically heat treating chemical yarns by applying different temperatures on either side of a plane passing through two generatrices of a peripheral surface of each orifice through which the yarns are extruded during production. One side of the plane is preferably at a temperature slightly higher than the melting point of the material and the other side of the plane is preferably at a temperature slightly lower than the decomposition point of the material.

5 Claims, 9 Drawing Figures

FIG. 7
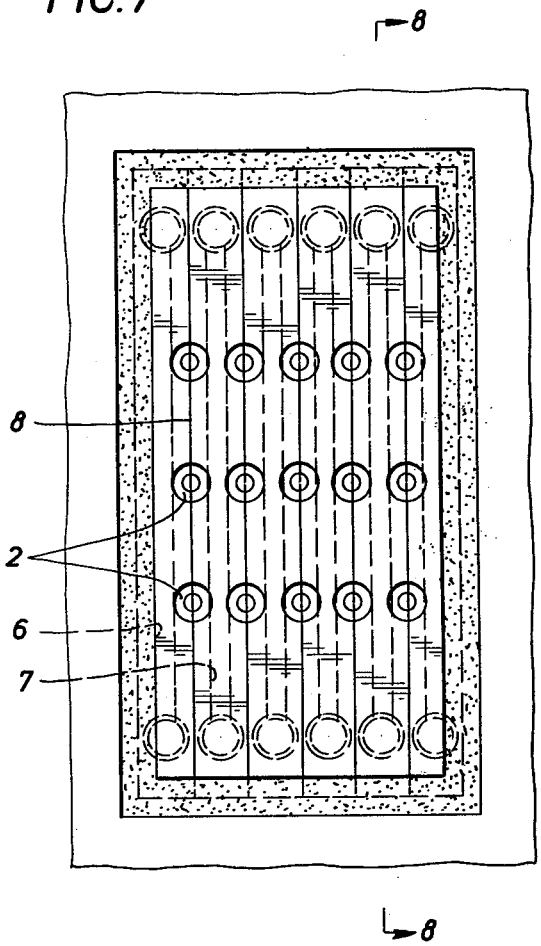
FIG. 8
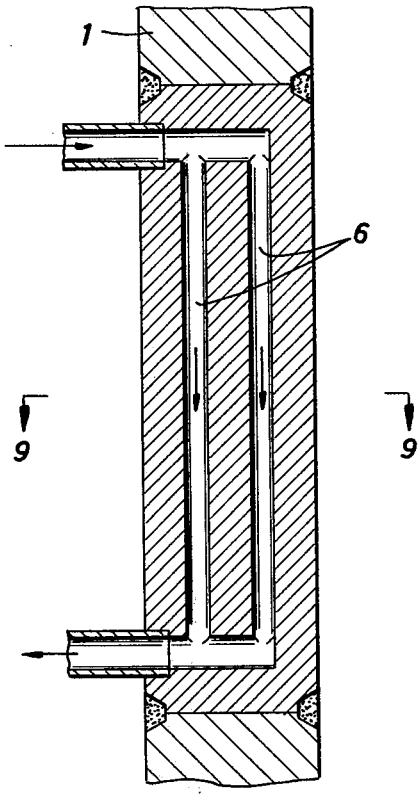
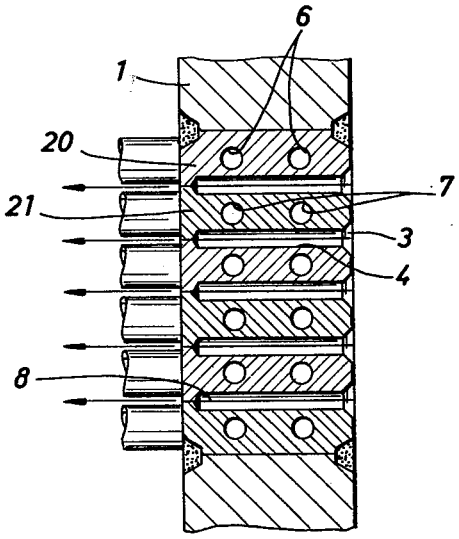
FIG. 9

PROCESS FOR PRODUCTION OF CRIMPABLE CHEMICAL YARNS

BACKGROUND OF THE INVENTION

1. Field of the Invention

This invention relates to the production of crimpable chemical yarns and more specifically to the production of such yarns simultaneously with the generation of potentially crimpable chemical yarns by shaping and heating thereof.

The present invention relates to both the process for the production of such yarns and to the apparatus for carrying out the process.

2. Description of the Prior Art

In the remainder of the description, the term "chemical yarn" denotes any yarn based on an organic material, which is obtained by spinning such material through a spinneret pierced with holes.

As materials suitable for the manufacture of chemical yarns, there may be mentioned, among converted natural polymers, those known under the names cupro, viscose, modal, deacetylated acetate, acetate, triacetate and the like, and among synthetic polymers, those known under the names acrylic, modacrylic, polyamide, polycarbamide, polyester, polyethylene, polypropylene, polyvinyl and the like.

It is well known that, after extrusion, chemical yarns are generally subjected to various treatments intended to impart particular properties, and especially characteristics of bulk and/or of elasticity, to the yarns. In general, the bulk and/or the elasticity is obtained by giving the filaments a suitable permanent crimp or waviness.

One of the most widespread treatments, especially as regards yarns based on a thermoplastic, is the so-called texturizing or crimping treatment, which consists in permanently deforming the yarn. This may be accomplished, for example, by imparting a false twist thereto, compressing it, subjecting it to the action of a jet of fluid, passing it over a sharp edge between gearwheels, and so on, the deformation thus imparted to the filaments being set-in by heat treatment and cooling. This texturizing or crimping operation is generally carried out in a separate stage after spinning.

In order to reduce the cost and increase productivity, it has been proposed to combine the texturizing or crimping operation with a spinning operation. However, although this technique gives good results, it requires the use of hardware in addition to the spinning installation, in order to impart the desired effect to the yarns. For a long time, the producers of chemical yarns have therefore been attempting to obtain yarns or fibers which are crimped directly during the spinning operation, without employing the convention texturizing or crimping processes.

Among the solutions proposed, the best known consists in spinning yarns which are said to have "potential crimp", that is, yarns of which the constitution is such that a crimp or waviness can be developed subsequently by simple drawing and/or heating. Yarns of this type, which are frequently denoted by the expression "bicomponent yarns", are obtained, for example by extruding, for each filament forming the yarn, two polymers of different types or the same polymer in two different physical states, the polymers being arranged either side-by-side or in a core-sheath relationship or in a random distribution.

After subsequent treatment, this technique makes it possible to obtain strongly crimped and/or waved yarns, but the technique disadvantageously requires distributing devices in front of the spinneret which are complex, fragile and difficult to produce. Thus, this technique has not been developed.

It has also been proposed to manufacture yarns, having potential crimp, from a single polymer which is spun using conventional spinnerets, the extruded yarn being subjected after extrusion, to an asymmetric heating or cooling process, which theoretically produces a yarn having potential crimp.

It must be recognized that this solution has not given good results, which is easily explained by the fact that the extruded yarn is composed of a plurality of filaments and as a result, it is not possible to modify the structure of each filament in an identical manner. Furthermore, this type of process is rather difficult to carry out.

Finally, it has also been proposed to produce potentially crimpable chemical yarns by creating during spinning, a variation in the viscosity of the polymer mass before passage through the spinneret, so as to obtain in each filament forming the yarn, a viscosity which varies from one side to the opposite side of the same filament, the crimp also being developed by subsequent heat treatment, which treatment is optionally combined with the drawing operation. This type of process is described in French Pat. No. 2,143,793.

In general, according to this document, the material is subjected to asymmetric heat treatment, while it is being extruded, by means of heating elements which act directly on the material inside the spinning holes. This process is also complex and difficult to carry out.

Therefore, it is a feature of the present invention to produce by an improved process potentially crimpable chemical yarn while simultaneously subjecting it to shaping and heat treatment, thereby also achieving actual crimpable yarn.

It is another feature of the present invention to provide an improved process of and apparatus for producing crimpable chemical yarn by drawing and extruding potentially crimpable chemical yarn through an orifice having two generatrices of its peripheral surface while simultaneously subjecting it to assymetricaly heating.

SUMMARY OF THE INVENTION

The invention involves the process of extruding potentially crimpable yarn through an orifice having a generatrix lead-in portion while heating one side of a plane passing through the centerline or other segmenting line of the orifice (the so-called "extrusion plane") at a temperature slightly higher than the melting point of the material and the other side of such plane at a temperature slightly lower than the decomposition point of the material.

A preferred embodiment of the invention includes a metal spinneret plate having a plurality of two-dimension orifices. An insulation material is located in a groove along a plane passing through the centerline of the orifices. Separate channels for carrying heated fluids pass through the plate on opposite sides of the plane through the orifices. A first one of these channels carries fluid for heating one side of the plane to a first temperature, and hence one side of the surface peripheries of the generatrices of the orifices through which the yarn filaments are drawn during their generation. The second of these channels carries fluid for heating the other side of the plane to a second temperature level, and hence the other side of the surface peripheries of the generatrices of the orifices through which the yarn filaments are drawn during their generation.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only typical embodiments of the invention and are therefore not to be considered limiting of its scope, for the invention may admit to other equally effective embodiments.

In the Drawings:

FIGS. 7, 8 and 9 show, in detail, yet another embodiment of a spinneret plate according to the present invention, viewed respectively from above or below (FIG. 7), in section along axis A—A (FIG. 8) and along axis B—B (FIG. 9).

DESCRIPTION OF PREFERRED EMBODIMENTS

Figure 1:
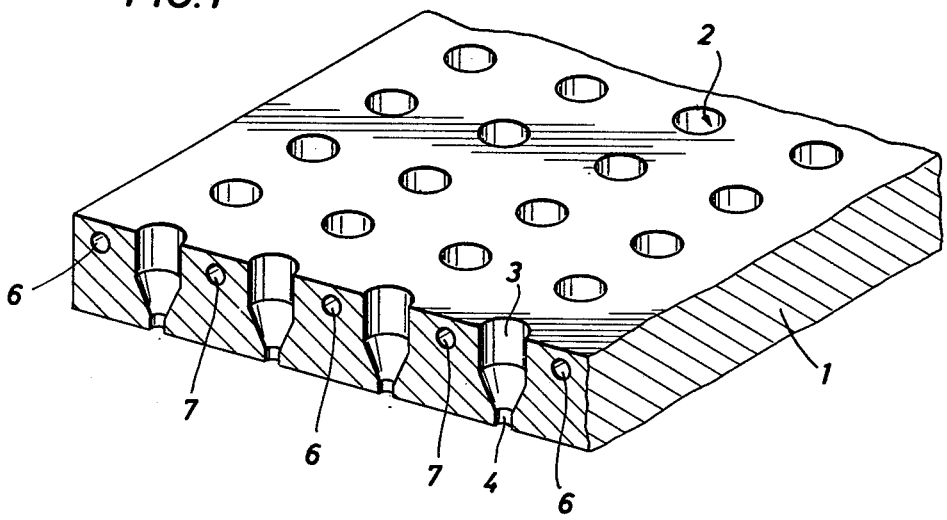
FIG. 1 is a schematic representation, in perspective, of a first embodiment of a spinneret plate in accordance with the present invention.

A simple and effective process has been found which makes it possible to obtain yarns having potential crimp for virtually all types of polymer capable of forming filaments. It is this process, and the apparatus for implementing this process, which forms the subject of the present invention.

In the remainder of the description, the invention is described in conjunction with the production of continuous multifilament yarns, but it is obvious that the invention also applies to the fibers obtained from filaments crimped according to the invention.

The invention also relates to various apparatus which make it possible to carry out the inventive process.

The process according to the invention for the production of a multifilament yarn having potential crimp operates in conjunction with the production of such yarn in a known manner by way of extruding a material which is capable of forming continuous filaments through a spinneret pierced with orifices. In accordance with the invention the material is subjected to asymmetric heat treatment during extrusion. The asymmetric heat treatment of the material is achieved by applying thereto, while it is passing through the extrusion orifices, a different temperature on either side of a plane passing through two generatrices of the peripheral surface of each orifice.

By way of simplification, this plane passing through two generatrices of the peripheral surface of each orifice is sometimes denoted herein by the expression "extrusion plane" in the remainder of the description.

According to the invention, during extrusion a different temperature is applied to the extruded material on either side of the extrusion plane of the material, one of the sides of the plane being at a slightly higher temperature than the melting point of the material, and the other side of the plane being at a slightly lower temperature than the crosslinking temperature or the decomposition point of the material. This difference between the two sides of the extrusion plane can be achieved either by heating or by cooling one of the sides relative to the other.

Advantageously, according to a preferred embodiment of the invention, a sudden temperature change is caused at the extrusion plane. This sudden change in temperature is possible to achieve, for example, by creating a solution of continuity at the peripheral surface of the extrusion orifice, at the level of the generatrices defining the extrusion plane. Furthermore, in order to make it easier to maintain the temperature difference between the two sides of the extrusion plane, it is possible, still according to the invention, to arrange a layer of insulating material joining adjacent generatrices of two successive orifices, essentially at the level of the extrusion plane.

In one embodiment of the process according to the invention, the temperature difference between the two sides of the extrusion plane inside the spinneret is achieved by means of heating elements which are arranged on either side of the spinning orifices and heated to different temperatures such that the material extruded is at a slightly higher temperature than its melting point on one side of the extrusion plane, and at a slightly lower temperature than its decomposition point or crosslinking temperature on the other side.

Any appropriate means can be used as heating elements, for example electrical resistances or tubes containing a heat-transfer fluid. These elements are conveniently embedded in the body of the spinneret plate on either side of the extrusion orifices.

It is obvious that the invention applies both in the case of spinnerets in which the extrusion orifices are arranged in the form of parallel rows, and in the case of spinnerets in which the extrusion orifices are arranged in a circular manner.

The temperature difference between the two sides of the extrusion plane can easily be determined by those skilled in the art as a function of the material extruded, and can preferably be established as close as possible to the maximum temperature difference permisssible for suitable spinning of the material.

Thus, for example, it is well know that polyamide 6,6 and polyester have a melting point of about 265° C., that they must be spun at about 285° C. and that, above 300° C., they crosslink or degrade very rapidly. Consequently, when extruding such material according to the invention, one of the sides of the extrusion plane can be heated to a temperature which makes it possible to apply a temperature of about 265° C. to the material from one direction and the other side can be heated to a temperature which makes it possible to apply a temperature of about 300° C. to the material from the other direction.

By way of simplification and in order to clarify the description, the elements arranged upstream and downstream from the spinneret according to the invention are not shown in these examples, since these elements are conventional in the manufacture of chemical yarns.

Furthermore, for convenience in the attached drawings, the same elements are denoted by the same reference numbers.

Now referring to the drawings and first to FIG. 1, the apparatus according to the invention for the production of potentially crimpable yarns essentially comprises a metal spinneret plate 1, for example made of stainless steel. This plate 1 is pierced with a plurality of extrusion orifices 2, which are arranged in parallel rows and essentially possess an enlarged lead-in dimension 3 extended by an outlet orifice dimension 4 of given cross-section.

According to the invention, the heating elements 6 and 7 are arranged on either side of the extrusion orifices. These heating elements are alternately at different temperatures, elements 6 being, for example, at a higher temperature than the elements 7, so that the extrusion orifices are heated to different temperatures on either side of their extrusion plane 8.

According to the invention, one of these elements, for example 6, is at a temperature such that the temperature-determining element applies to the polymer a slightly lower temperature than the decomposition point, and the other element, in this case 7, applies to the polymer a slightly higher temperature than the melting point of the polymer.

Heating elements 6 and 7 are preferably in the form of continuous tubes or channels containing a heat-transfer fluid, the tubes at the same temperature being joined in series to a source of feed and a means of discharge.

Furthermore, the depth of the lead-in portion of the extrusion orifice must be such that the extruded material is at a different temperature on either side of the extrusion plane.

Figure 2:
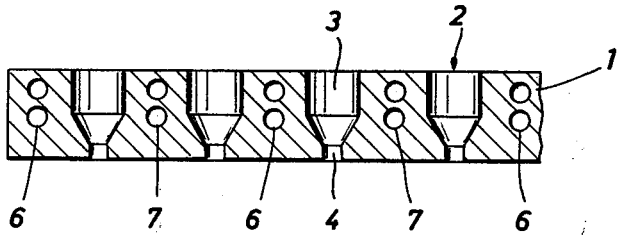
FIG. 2 is a transverse section showing another embodiment of a spinneret plate in accordance with the present invention.

FIG. 2 illustrates a variant of FIG. 1, utilizing several heating elements 6 and 7 which are arranged on each side of the extrusion plane so as to have more uniform heating over the depth of lead-in portion 3.

Figure 3:
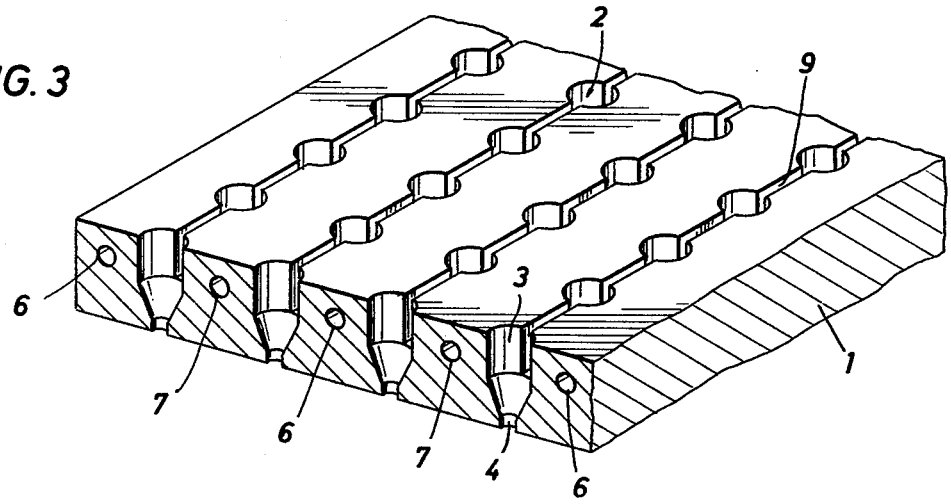
FIG. 3 is a schematic representation, in perspective, of yet another embodiment of a spinneret plate in accordance with the present invention showing insulating material joining comparable generatrices of successive orifices.
Figure 4:
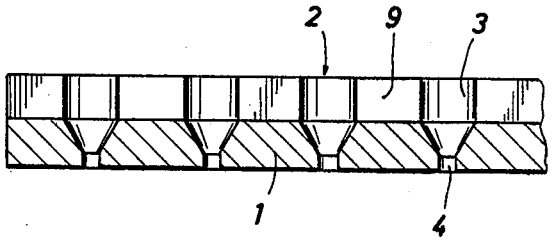
FIG. 4 is a partial sectional view of FIG. 3 taken along the centerline of a row of successive orifices.

FIGS. 3 and 4 illustrate a further embodiment according to the invention, in which embodiment the extrusion orifices are arranged in parallel rows, each orifice possessing a solution of continuity at the extrusion plane and at the approximate level of the generatrices formed by the lead-in portions of the orifices, adjacent generatrices of successive orifices being joined. The solution of continuity is accomplished by means of an insulating material 9, for example a pure or filled thermostable plastic of the type marketed under the trademarks TEFLON or KERMEL. Any other insulating material, for example mica, could optionally be used.

In the manner just described, it is possible to achieve a sudden temperature change approximately in the region of the extrusion plane between the two sides of the material extruded.

The production of the apparatus described above is simple. For example, during the manufacture of the spinneret it is possible to provide the latter with grooves which are approximately along the axis of each row of orifices. These grooves are provided with a depth which approximately corresponds to the depth of the lead-in. The grooves are subsequently filled in with an insulating material, and then the lead-in and finally the outlet orifice are pierced.

Figure 5:
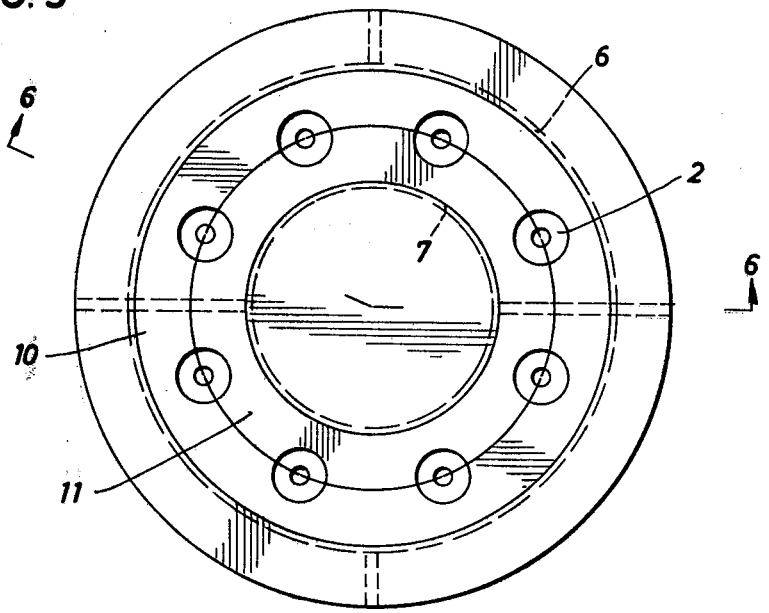
FIGS. 5 and 6 are simplified views, from above and taken in section along line C—C, of still another embodiment of a spinneret plate according to the present invention, in which extrusion orifices are arranged in a circular manner.
Figure 6:
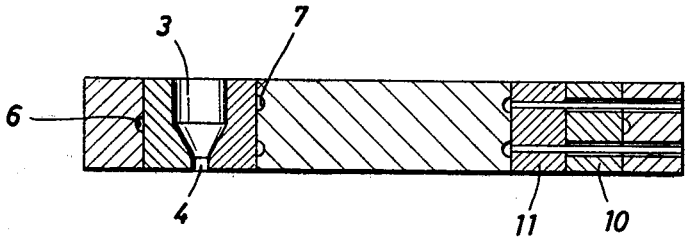

FIGS. 5 and 6 illustrate a further variant of a spinneret according to the invention in which the extrusion orifices are arranged in a circular manner.

In this embodiment, the extrusion orifices 2 are heated by means of circular tubes 6 and 7 which are connected by channels or conduits to means for feeding and discharging the heat-transfer fluids.

The orifices can advantageously be pierced in a unit consisting of two different concentric ring-like elements 10 and 11, forming a solution for continuity at the level of the generatrices defining the extrusion plane. These elements can either be made of identical materials or of different materials, which makes it easier to achieve the temperature difference in the region of the extrusion plane.

FIGS. 7, 8 and 9 illustrate an embodiment of a spinneret according to the invention, in which the extrusion orifices are aligned. This spinneret consists of a set of juxtaposable unit blocks 20 and 21, each block 20 and 21 including tubes 6 or 7, and in which it is suitable for the flow of a heat-transfer fluid heated to different temperatures. The spinning orifices 2 are produced with half in block 20 and half in block 21 so that when the blocks are juxtaposed, there is a solution for continuity at the level of the lead-in dimension along extrusion plane 8, the lead-in dimension forming the level of the generatrices.

By virtue of the process and the apparatus according to the invention, it is possible to obtain potentially crimpable yarns simply, economically and with virtually no modification of the spinning equipment currently commonly in use, regardless of the extruded material used for spinning.

While particular embodiments of the invention have been shown and described, it will be understood that the invention is not limited thereto, since many modifications may be made and will become apparent to those skilled in the art.

Therefore, it is obvious that the invention is not restricted to the examples given above, but that it also encompasses all the variants. Thus, the extrusion orifices can be non-circular and/or the extrusion plane can be staggered relative to the longitudinal axis of the orifices.

Furthermore, the scope of the invention is not exceeded by applying to the polymer a different temperature on either side of the extrusion plane, for example in the immediate vicinity of the spinneret.

Furthermore, it is obvious that the degree of crimp can be varied for the same material by altering the temperature difference on either side of the extrusion plane.

Finally, it is well known that the decomposition of the polymer depends not only on the temperature but also on the duration of heating. Consequently, the scope of the invention is not exceeded by applying to the polymer a considerably higher temperature than the temperature usually considered as the decomposition temperature, provided, however, that the polymer is not decomposed at this temperature, this being achieved for example by reducing the duration of heating.

What is claimed is:

1. In a process for the manufacture of potentially crimpable yarn so as to form actual crimps therein simultaneously with production, wherein said process comprises, in combination extruding a chemical yarn material through a plurality of adjacent extrusion orifices, and asymmetrically temperature-treating the material during extrusion thereof, the improvement comprising providing each of said extrusion orifices with a lead-in generatrix portion, the internal peripheral surface of which is divided into a first segment and a second segment as determined by an extrusion plane therethrough, and providing the asymmetrical temperature by treating one side of the extrusion plane at a first level such that this side is at a temperature slightly higher than the melting point of the material, and the other side of the plane is at a second level such that said other side is at a slightly lower temperature than the decomposition point of the material.

2. The process in accordance with claim 1, wherein said temperature treating is accomplished by heat treating.

3. The process in accordance with claim 1, wherein said temperature treating is accomplished by cooling at least said one side of the plane so as to be at a different temperature level than said other side.

4. The process in accordance with claim 1, wherein there is an abrupt temperature change between said one side of the extrusion plane and said other side of the extrusion plane.

5. The process in accordance with claim 4, wherein the abrupt temperature change is achieved by creating a solution of continuity at the peripheral surface of the extrusion orifice, at the level of the generatrices defining the extrusion plane.

* * * * *